United States Patent [19]

Starcke et al.

[11] Patent Number: 4,653,567

[45] Date of Patent: Mar. 31, 1987

[54] AUTOMATICALLY WINDING WINDOW SHADE

[75] Inventors: Carl Starcke; Werner Wielebinski, both of Melle, Fed. Rep. of Germany

[73] Assignee: Zundwarenfabrik Starcke GmbH & Co, Melle, Fed. Rep. of Germany

[21] Appl. No.: 761,104

[22] Filed: Jul. 31, 1985

[30] Foreign Application Priority Data

Aug. 2, 1984 [DE] Fed. Rep. of Germany ..... 3428483

[51] Int. Cl.[4] ..... E06B 9/24; E06B 9/206

[52] U.S. Cl. ..... 160/301; 160/320

[58] Field of Search ..... 160/320, 321, 301

[56] References Cited

U.S. PATENT DOCUMENTS

| | | | |
|---|---|---|---|
| 98,384 | 12/1869 | Imback | 160/320 |
| 105,871 | 7/1870 | Wilhelm | 160/320 |
| 166,561 | 8/1875 | Seehausen | 160/321 |
| 201,799 | 3/1878 | Lash | 160/320 |
| 1,417,298 | 5/1922 | Brock | 160/321 |
| 1,469,842 | 10/1923 | Livingston | 160/320 |
| 2,445,452 | 7/1948 | Peed | 160/321 |
| 4,347,885 | 9/1982 | Knorring | 160/320 |
| 4,424,851 | 1/1984 | Kohayakawa | 160/320 |

FOREIGN PATENT DOCUMENTS

| | | | |
|---|---|---|---|
| 3232722 | 3/1984 | Fed. Rep. of Germany . | |
| 3428483 | 6/1985 | Fed. Rep. of Germany . | |
| 112654 | 1/1918 | United Kingdom | 160/320 |

*Primary Examiner*—Reinaldo P. Machado
*Attorney, Agent, or Firm*—Michael J. Striker

[57] ABSTRACT

In a window shade which automatically winds up by a releasable spring mechanism, mounted in a rotatable shaft, a roll for a cord is secured to the end of the shaft. A free end of the cord is secured to the roll. The amount of the cord to be wound up on the roll corresponds to the entire winding length of the shade material. The cord forms a loop at which a hand grip is suspended.

10 Claims, 2 Drawing Figures

AUTOMATICALLY WINDING WINDOW SHADE

BACKGROUND OF THE INVENTION

The present invention relates to an automatically-winding window shade of the type provided with a self-winding spring mechanism and a rotation shaft for a pulling cord.

In conventional self-winding window shades of the type under consideration and known as spring window shades the shade material is connected to and wound up on the shaft in which the spring device is positioned. The spring is prestressed by mechanical elements upon lowering of the shade whereby a force occurs, which lifts up the shade when the above mechanical elements of the locking hooks in the spring mechanism are released. A so-called falling rod is positioned at the lower end of the shade material which rod makes the window shade smoothly hang. A pulling cord is secured to the middle of the rod. The mechanical arrangement with the hook-type locking mechanism can be held at a distance from the half-length of the unrolled window shade.

A disturbing fact in the known automatically-winding shades is, however that the cord of the lifted-up shade hangs at the center of the window. The pulling cord in the lowered position of the shade randomly lies on the window-sill or the floor. When the window shade, as usual, is connected to the wall at a relatively high level by supports it is necessary, however, to loosen the cord to completely lower the shade.

Also known are side pulling window shades. At the end of such a shade, an endless cord or string train is provided, which has tassels or balls and extends over the roll which is secured to the shade shaft. The window shade can, with the aid of the endless string train, be lowered and lifted when the shade is advanced at its side. The operation of such side pulling window shades is, however inconvenient because, first a user should stand at the side of the window shade and hold the cord with two hands and pull the same. By pulling the cord at one strand or the other the user lifts the window shade or pulls it down. A repeated loosening of the chord is necessary, which requires additional attempts and is inconvenient.

SUMMARY OF THE INVENTION

It is an object of the present invention to provide an improved automatically-winding window shade.

It is another object of this invention to provide a self-winding window shade in which the cord does not hang immediately in front of the window and which is easier to operate as compared to the side pulling window shades.

These and other objects of the invention are attained by an automatically-winding window shade, comprising a rotational shaft; a self-winding spring mechanism having hook locking means and positioned in said shaft; a roll connected to said shaft; and a pulling cord connected to a window shade material and being wound up and off said roll to lift or lower the window shade, said roll being secured to an end of said shaft, an amount of the cord wound up on said roll, corresponding to a pulling length of the window shade, said pulling cord extending from said roll down to a gripping level.

In the proposed window shade the cord does not hang up right in front of the window but at the side thereof.

In contrast to customary side pulling window shades the operation of the proposed window shade is very simple and the lowering of the window shade can be made by a single pulling. For lifting the shade material only the spring mechanism should be released.

The cord may form a loop and leads upwardly, said cord having an upper free end which is fixed. Thereby, upon loosening the cord, the latter is not damaged and does touch the floor when released.

The upper end may be at the level of said roll, said shaft at said end having a support, said upper end of the cord being fixed to said support.

The window shade may further include a hand grip which is suspended at said loop of the cord. Therefore the ratio between the path of the hand grip and that of the lowering shade material is about 1:2. The shade material falls when the hand grip is pulled down and the full pulling down of the window shade is obtained while the hand grip is always within the reach of a user.

The hand grip may have a roller, said loop is wrapped about said roller.

The roll may be secured to the end of said shaft by nails.

The window shade may further include a pin supported in said support and inserted through said roll axially into the end of said shaft so that said shaft is rotationally supported by said pin relative to said support.

The roll may have a casing surrounding the roll, said casing having a through opening for receiving the cord being wound on said roll therethrough.

The casing may have at least one pin extended rearwardly therefrom towards said support and eccentrically to an axis of the casing, said at least one pin being non-rotationally held in said support.

The casing may also include a hub concentric thereto and plugged into said support, said pin being positioned in said hub.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DETAILED DESCRIPTION OF THE PREFERRED EMBODIMENT

Figures 1, 2:
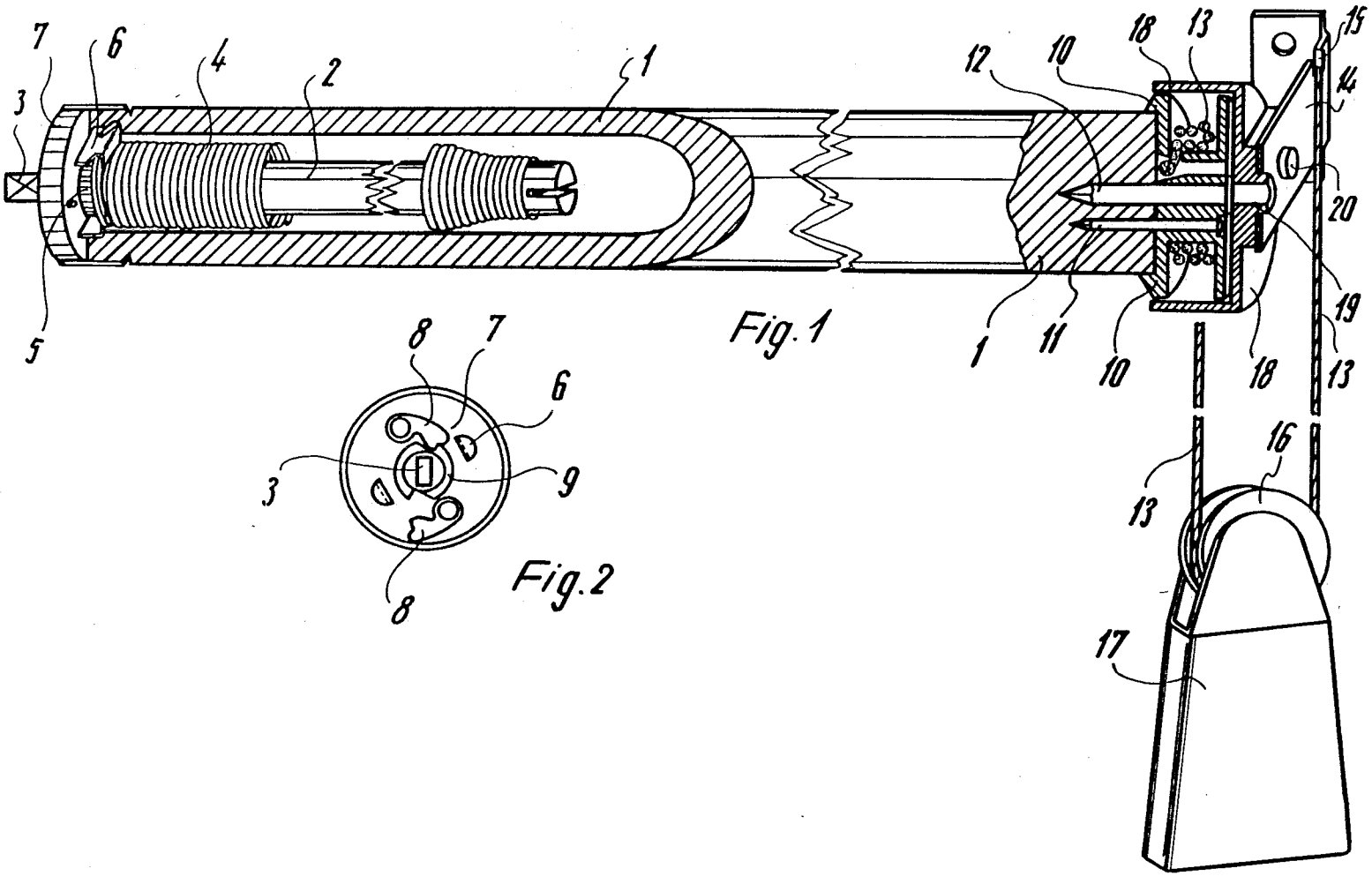
FIG. 1 is a partial sectional view through an automatically-winding window shade of the invention.
FIG. 2 is a front view of the window shade of FIG. 1.

Referring now to the drawings in detail it will be seen that the automatically-winding window shade includes a shaft 1 which is at one end thereof hollow or recessed to receive a spring mechanism. The spring mechanism includes a supporting spindle 2 which is rigidly connected to a square pin 3 which in turn is rotation-fixedly plugged in a support not shown in the drawing. That support itself is secured in the known fashion to the building wall at which the support can be either hung up or placed in a niche. A self-winding spring 4 is positioned on the supporting spindle 2. This spring at the right-hand end is secured in the slot of the supporting spindle. A bridge-like cross-piece 5 is rotationally supported on the other end of the supporting spindle 2. The cross-piece 5 engages the spring mechanism 4 with two diametrally opposing bars or struts 6. Struts 6 are engaged with the inner wall of the recessed shaft 1 and are, due to their deflection, fixed in the shaft 1. The cap-shaped housing is denoted by reference numeral 7. Two diametrally opposing locking pins 8 are rotationally supported under their own weight in the housing 7. Locking pins 8 cooperate with a locking disc 9 rigidly secured on the square pin 3 in the fashion known for window shades provided with spring mechanisms. The back-side cross-piece 5 is therefore in a rotation connection either with the shaft 1 or with the cap 7.

At the other end of the shaft, opposite to the spring mechanism, a cord roll 10 is positioned, also connected to shaft 1. Roll 10 is mounted to shaft 1 by one or a number of nails 11. An end pin 12, which extends along the central axis of roll 10 and also axially of shaft 1, is provided, by means of which the end of shaft 1 can be rotationally supported.

The end of a string or cord 13 is connected to the roll 10. The amount of the cord wound up at a cord receiving channel of the roll 10 corresponds to the entire pulling or winding length of the shade material (not shown), connected to shaft 1.

Cord 13 extended from the roll 10 leads then downwardly to a convenient gripping height, for example 1.7 m, and then with the formation of a loop again upwardly and up to the level of roll 10 and to a support 14 on the wall of the building. The free end of cord 13 is then connected to the support 14. A node, made at the end of the cord, is inserted in a slot 15 provided in the support 14.

The loop formed on the cord 13 hangs on a track wheel 16 provided on the hand grip 17.

If the hand grip 17 is pulled then, due to the fixed position of the free end of cord 13, rotation of roll 10 and shaft 1 take place, which causes lowering of the window shade to a desired level. Upon the release of one of the locking hooks 8 the shade can be again lifted up by the automatically-winding spring mechanism 4.

During the lowering of the window shade by means of hand grip 17 the latter moves in the ratio with the length of the lowering shade material, which is about 1:2. The shade material falls also by a double height and the hand grip is pulled down. For pulling the grip in the backward direction for example by 0.75 m, the shade material is lowered by 1.5 m.

The roll 10 with the cord 13 wound thereon is enclosed in a casing or cap 18 which at the same time forms at its hub 19, inserted in the support 14, a rotation bearing for pin 12. In order to prevent that cap 18 would be taken along by roll 10 during the rotation of the shaft 1 and roll 10, a pin 20 is provided at the back side of the cap, which pin can be inserted into a respective receiving bore of support 14.

Cap or casing 18 has a sleeve portion surrounding roll 10, the sleeve portion having a through opening (not shown) for cord 13. This opening serves also as a guide for the cord. The cord is not guided again upwardly. The cord is provided at the level of gripping with a tassel or the like.

It will be understood that each of the elements described above, or two or more together, may also find a useful application in other types of automatically-winding window shades differing from the types described above.

While the invention has been illustrated and described as embodied in a self-winding window shade, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

I claim:

1. In an automatically-winding window shade, comprising a rotational shaft; and a self-winding spring mechanism having hook locking means and positioned in said shaft; the improvement comprising a roll connected to said shaft; and a single pulling cord positioned laterally of a window shade material and connected thereto and being wound on and off said roll to left or lower the window shade, said roll being secured to an end of said shaft, an amount of cord wound up on said roll corresponding to a pulling length of the window shade, said pulling cord extending from said roll down to a gripping level.

2. The window shade as defined in claim 1, wherein said cord forms a loop and leads upwardly, said cord having an upper free end which is fixed.

3. The window shade as defined in claim 2, wherein said upper end is at the level of said roll, said shaft at said end having a support, said upper end of the cord being fixed to said support.

4. The window shade a defined in claim 3, further including a hand grip which is suspended at said loop of the cord.

5. The window shade as defined in claim 4, said hand grip having a roller, said loop is wrapped about said roller.

6. The window shade as defined in claim 1, wherein said roll is secured to the end of said shaft by nails.

7. The window shade as defined in claim 3, further including a pin supported in said support and inserted through said roll axially into the end of said shaft so that said shaft is rotationally supported by said pin relative to said support.

8. The window shade as defined in claim 7, wherein said roll has a casing surrounding the roll, said casing having a through opening for receiving the cord being wound on said roll therethrough.

9. The window shade as defined in claim 1, said shaft having a support and said roll having a casing, said casing having at least one pin extended rearwardly therefrom towards said support and eccentrically to an axis of the casing, said at least one pin being non-rotationally held in said support.

10. The window shade as defined in claim 8, wherein said casing has a hub concentric thereto and plugged into said support, said pin being positioned in said hub.

* * * * *